United States Patent [19]

Hatz

[11] 4,064,853

[45] Dec. 27, 1977

[54] INTERNAL COMBUSTION ENGINE WITH A PRESSURE-COMPENSATING ARRANGEMENT IN THE CRANKCASE OF THE ENGINE

[75] Inventor: Ernst Hatz, Ruhstorf, Germany

[73] Assignee: Motorenfabrik Hatz GmbH & Co. KG, Ruhstorf, Germany

[21] Appl. No.: 712,779

[22] Filed: Aug. 9, 1976

[30] Foreign Application Priority Data

Aug. 12, 1975 Germany ..... 2535950

[51] Int. Cl.[2] ..... F02M 25/06

[52] U.S. Cl. ..... 123/119 B

[58] Field of Search ..... 123/119 B

[56] References Cited

U.S. PATENT DOCUMENTS

| | | | |
|---|---|---|---|
| 2,775,960 | 1/1957 | Druzynski | 123/119 B |
| 3,056,420 | 10/1962 | Dietrich | 123/119 B |
| 3,108,581 | 10/1963 | Humphreys | 123/119 B |
| 3,455,285 | 7/1969 | Sheppard | 123/119 B |
| 3,664,368 | 5/1972 | Sweeney | 123/119 B |

FOREIGN PATENT DOCUMENTS

| | | | |
|---|---|---|---|
| 171,473 | 11/1934 | Switzerland | 123/119 B |
| 380,655 | 9/1932 | United Kingdom | 123/119 B |

*Primary Examiner*—Wendell E. Burns

*Attorney, Agent, or Firm*—Blanchard, Flynn, Thiel, Boutell & Tanis

[57] ABSTRACT

An internal combustion engine having an arrangement for compensating for the pressure in the crankcase of the engine. The arrangement includes a control valve which is arranged so that it is exposed on the one hand to the pressure in the crankcase and on the other hand to the pressure prevailing in an operating chamber which is separate from the connection conduit between the crankcase and the suction pipe and communicates with the atmosphere through an auxiliary conduit.

6 Claims, 2 Drawing Figures

22a
22
32
34
40
30
A
28
22e 18
14
14a
16
22a
22
32
A
40
38
36
34
30
28
22e
42
21
26
24
10
20
12

INTERNAL COMBUSTION ENGINE WITH A PRESSURE-COMPENSATING ARRANGEMENT IN THE CRANKCASE OF THE ENGINE

FIELD OF THE INVENTION

The invention relates to an internal combustion engine with a pressure-compensating arrangement in the crankcase of the engine, this including a valve-controlled connection conduit between the crankcase and the suction conduit of the engine. A pressure-compensating arrangement of this nature is used to conduct the combustion gases, present in the crankcase as a result of imperfect sealing, back to the suction system of the engine after a pre-set pressure level is reached, thereby preventing unnecessary pollution of the surroundings.

BACKGROUND OF THE INVENTION

In known arrangements of this character, it has been found that as the contamination increases in the air filter which is used in the suction system, for example where there is poor maintenance, the reduced pressure in the suction system of the engine becomes particularly severe and affects the pressure compensation very unfavorably despite interposed valves. In addition to this it has been found that even the pulsations in the quantities of discharge gases in the crankcase itself cannot be trapped by known arrangements. Again, irregular and uncontrollable flows or fluctuations of quantities of gas occur in the connection conduit and these frequently drag oil from the crankcase into the suction system to cause familiar disadvantageous phenomena. Moreover, the pressure is frequently reduced to an excessive extent and this permits incursion of dust and contaminant particles from the exterior through small gaps in the sealing means of the crankcase. These intruding particles cause considerable damage to the sliding and control surfaces on moving parts in the crankcase and produce excessive wear of these elements. This notably reduces the length of life of the engine.

It is an object of the invention to remove these shortcomings and to relieve the control valve in the connection conduit to a maximum degree of these detrimental effects. This problem is solved in the present invention by the fact that the control valve is so arranged that it is exposed on the one hand to the pressure in the crankcase and, on the other hand, to the pressure prevailing in an operating chamber which is separate from the connection conduit and communicates with atmosphere through an auxiliary conduit. By these means fluctuations in underpressure at the suction side of the engine cannot have any detrimental effect on the control valve. Moreover, the pressure compensation will be regulated in dependence only on the pressure level in the crankcase.

In a preferred embodiment of the invention, the arrangement is such that the operating chamber is formed directly in the connection conduit by a shut-off member and at the same time an overflow connection is provided under the control of the valve to make or interrupt the connection between the crankcase and the suction pipe. Advantageously, the overflow connection comprises a tubular jacket which encloses and is spaced from the connection conduit in the zone of the operating chamber, and transverse holes which are arranged fore and aft of the operating chamber.

It is particularly advantageous when the control valve is in the form of a piston which, in its rest position, closes the transverse holes which permit entry of the overflow gases into the tubular jacket. The connection conduit can be approximately vertical and the piston held in its rest position by gravity. In a further useful arrangement, the piston is loaded by an adjustable return spring. By these means, the pressure level in the crankcase can be maintained either by appropriate choice of the piston weight or by appropriate adjustment of the power of the return spring.

It is to be noted that the control valve may be in the form of a ball valve.

BRIEF DESCRIPTION OF THE DRAWING

An example of embodiment of the invention will now be described below in reference to the accompanying drawing, in which.

DETAILED DESCRIPTION

Figures 1, 2:
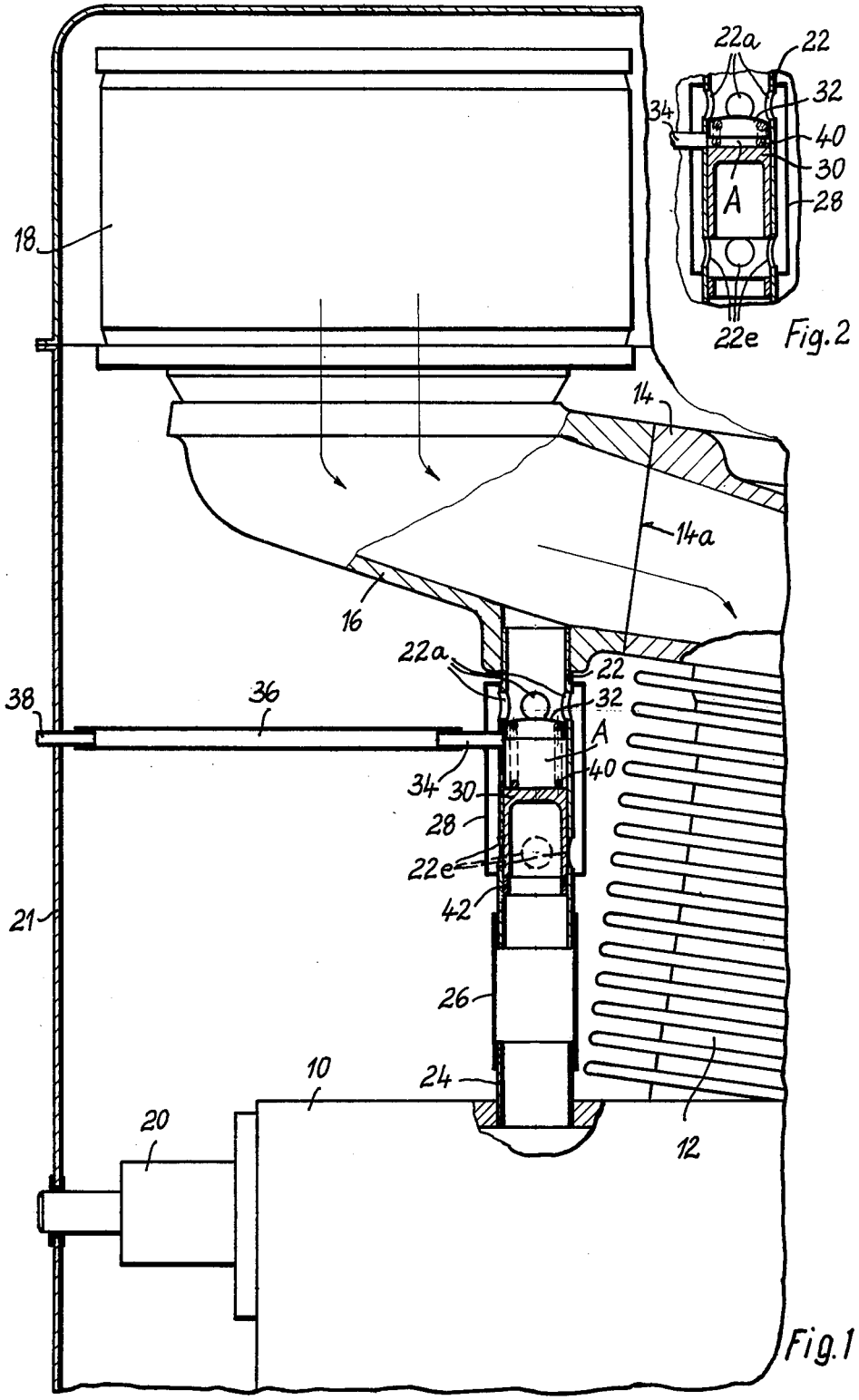
FIG. 1 shows an engine equipped with a pressure balancing arrangement in accordance with the invention, in the rest condition.
FIG. 2 is a fragmentary view of part of the arrangement shown in another operating condition.

The internal combustion engine illustrated in the drawing is of a known type and comprises a crankcase 10, a cylinder 12 and a cylinder head 14. A suction pipe 16 is connected to the inlet port **14*a* over the head 14 and carries at the entrance a paper air filter 18. The crankshaft mounted in crankcase 10 is designated at 20. The engine is enclosed in a sound deadening shell 21**.

The combustion gases which penetrate to the interior of the crankcase by virtue of imperfect sealing between the cylinder and the piston have to be vented after they have reached a predetermined pressure level. To avoid pollution of these surroundings, these waste gases are conducted back to the suction system of the engine, a valve-controlled connection conduit between the crankcase and the suction pipe being used for this purpose. As illustrated in the drawing, this connection conduit is constituted by a length of piping 22 seated in the part 16 and a further length of piping 24 mounted in the crankcase 10, these lengths of piping being connected by a hose 26. A tubular jacket 28 encloses the piping 22 and makes an overspill connection between four transverse holes **22*e* and four transverse holes 22*a* in the piping 22**.

Arranged in the piping 22 is a valve in the form of a piston 30. A cap 32 inserted in front of piston 30 defines an operating chamber A separate from the other conduits. An auxiliary conduit 34 passes through the tubular jacket 28 and the piping 22 and opens into the operating chamber A. The auxiliary conduit 34 is connected to the ambient surroundings of the engine, i.e. to atmosphere, via a hose 36 and a length of pipe 38. A return spring 40 is mounted in the chamber A and holds the piston 30 in its rest position, as determined by an abutment ring 42 firmly seated in the piping 22.

The return spring 40 is so dimensioned as to hold the valve piston 30 in the position illustrated in the drawing, in which position the pressure in the interior of the crankcase is slightly higher than atmospheric pressure. With this slight overpressure in the rest position, holes **22*e* are closed by piston 30, thereby interrupting the flow connection between the crankcase 10 and suction pipe 16. Whenever the pre-set pressure level is exceeded in the crankcase, piston 30 is lifted and the overflow connection is made through holes 22*e* into the space between the tubular jacket 28 and piping 22 and from here through the discharge holes 22a into the piping 22 and hence to the suction pipe 16**.

Thus, with the arrangement provided by this invention, acting on the valve piston 30 are not only the pressure in the crankcase 10 but also the constant atmospheric pressure in the operating chamber A (plus the calibrated force of spring 40). These various forces can be exactly applied and controlled. The underpressure in the suction system 16 of the engine, which is dependent on the prevailing contaminated condition of the air filter 18 and therefore fluctuates considerably, cannot have any effect on the valve piston 30. By reason of this, the pressure in the crankcase can be kept accurately at the pre-set pressure level when use is made of the pressure compensating arrangement in accordance with this invention. This eliminates the drawbacks of the known arrangements as set forth above.

It is also to be pointed out that the application of the invention is not limited to the specific example described above. Furthermore, the invention can be applied to other constructional arrangements, for example the control valve could be a ball valve.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An arrangement for compensating the pressure in a crankcase of an internal combustion engine, comprising:

conduit means for providing a fluid connection between said crankcase and a suction pipe for said engine, said conduit means including an operating chamber separate from said fluid connection and auxiliary conduit means for connecting said operating chamber to atmospheric pressure, said operating chamber being directly formed in said fluid connection;

bypass passageway means for providing passage of a fluid from said crankcase to said suction pipe around said operating chamber, said bypass passageway means comprising tubular jacket means enclosing and being spaced from said fluid connection along the length of said operating chamber; and a shut-off member mounted in said operating chamber and adapted to make or interrupt the connection between said crankcase and said suction pipe through said fluid connection and said bypass passageway means.

2. An arrangement for an internal combustion engine according to claim 1, wherein said tubular jacket means includes transverse holes which are arranged fore and aft of said operating chamber to provide a fluid connection between said conduit means and said bypass passageway means fore and aft of said operating chamber.

3. An arrangement for an internal combustion engine according to claim 1, wherein said shut-off member is in the form of a piston which, in its rest position, closes said transverse holes which permit entry of the overflow gases from said crankcase into said tubular jacket means.

4. An arrangement for an internal combustion engine according to claim 3, wherein said conduit means is approximately vertical and said piston is held in its rest position by gravity.

5. An arrangement for an internal combustion engine according to claim 3, wherein said piston is biassed in its rest position by an adjustable return spring.

6. An arrangement for an internal combustion engine according to claim 1, wherein said shut-off member is a spring-loaded ball valve.

* * * * *